US007446593B2

(12) United States Patent
Kilian et al.

(10) Patent No.: US 7,446,593 B2
(45) Date of Patent: Nov. 4, 2008

(54) POWER SUPPLY WITH PROGRAMMABLE FUSE FOR MODE SELECTION

(75) Inventors: Wayne T. Kilian, Richardson, TX (US); Jeffrey S. Hall, Winnebago, IL (US); Ryan R. Furio, West Chicago, IL (US); Jason M. Chilcote, Frisco, TX (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/006,245

(22) Filed: Dec. 7, 2004

(65) Prior Publication Data

US 2006/0119334 A1 Jun. 8, 2006

(51) Int. Cl.
*H01H 37/76* (2006.01)

(52) U.S. Cl. ..... 327/525; 327/530

(58) Field of Classification Search ..... 327/525, 327/530

See application file for complete search history.

(56) References Cited

U.S. PATENT DOCUMENTS 5,295,058 A * 3/1994 McGreevy ..... 363/26
5,790,469 A * 8/1998 Wong ..... 365/226
6,392,468 B1 5/2002 Wu ..... 327/525
6,522,981 B2 * 2/2003 Smit et al. ..... 702/60
6,624,499 B2 9/2003 Kothandaraman et al. ... 257/529
6,693,413 B1 2/2004 Lanni ..... 323/297
6,707,284 B2 * 3/2004 Lanni ..... 323/297
6,781,437 B2 8/2004 Ma ..... 327/525
6,809,943 B2 * 10/2004 Lanni ..... 363/144

* cited by examiner

*Primary Examiner*—Kenneth B. Wells
(74) *Attorney, Agent, or Firm*—Luis M. Ortiz; Kermit D. Lopez

(57) ABSTRACT

A voltage regulator operable as a voltage follower while a fusible link is closed and in a regulated voltage mode when the fusible link becomes open. The voltage regulator can be formed on monolithic semiconductor chips. Patterned thin films including aluminum and nickel-iron, and aluminum and polycrystalline silicon, comprise the fusible link. With the fusible link closed, the voltage regulator output is an analog of positive polarity variable voltage levels at the regulator input. Systems powered by the voltage regulator are allowed to be programmed until system programming requiring variable voltage levels is complete. Afterwards, a negative polarity voltage is applied to the regulator input causing a large current to pass through the fusible link once the system programming is completed. Current thereby causes the fusible link to become opened and enables the voltage regulator to begin operating at a regulated voltage in response to positive voltage input.

13 Claims, 3 Drawing Sheets

POWER SUPPLY WITH PROGRAMMABLE FUSE FOR MODE SELECTION

FIELD OF THE INVENTION

Embodiments are generally related to adjustable voltage regulators. More particularly, embodiments are related to a voltage regulator including a fusible link for mode selection.

BACKGROUND

A device "A" may need to have an input signal fluctuate between 2 voltage levels to allow for programming. If a device "B," a voltage regulator, is in front of device "A," the input voltage level to device "A" remains at a fixed level and won't provide the proper signaling for programming. If device "A" is calibrated by programming, its response to an external stimulus, and if its response is dependent on its spatial orientation, then it is advantageous to program "A" after the assembly comprising "A" and "B" is completed. A need therefore exists to allow device "B" to initially start in a non-regulating mode to allow signal fluctuations to go through device "B" thus programming device "A" in situ. Once programming has been completed, device "B" can be put in a voltage regulation mode by blowing a fuse.

BRIEF SUMMARY

It is one feature of the present invention to simplify power supply design where fluctuating voltage levels are initially required to program a system, but then a regulated voltage is required by the system after programming.

It is another feature of the present invention to allow digital programming data encoded as fluctuations of the voltage at the voltage regulator input, in the forward (positive) polarity, to be reproduced at the output of the voltage regulator chip if electrical continuity of a fusible link is present. Once the programming is complete, the programming mode is disabled and the voltage regulation mode is enabled by reversing the input voltage polarity, resulting in the blowing of the fuse. This one-time-programmable option requires no additional electrical terminal, but an additional terminal can be provided to allow optional repetitive use of the programmability function.

It is another feature of the present invention that a power supply be provided that includes a voltage regulator that is inoperable to regulate voltage while a fusible link is closed and becomes operable in a regulated voltage mode when the fusible link becomes open.

Another feature of the present invention is that the voltage regulator and fusible link can be formed on a monolithic semiconductor chip.

Yet another feature of the present invention is that the fusible link be further comprised of patterned thin films including at least one of aluminum and nickel-iron, and at least one of aluminum and polycrystalline silicon.

It is a feature of the present invention that during operation with the fusible link closed, the voltage regulator responds to positive polarity, fluctuating signals at its input with an analog of said signals at its output, until system programming requiring variable voltage levels is complete, where after the voltage source connected to the voltage regulator input causes a negative polarity signal to pass through the fusible link once the system programming is completed, said negative polarity signal thereby causing the fusible link to become opened and causing the voltage regulator to begin producing a regulated voltage at its output when a voltage of positive polarity and sufficient magnitude is there after applied to its input.

It is a feature of the present invention that the fusible link can be implemented in such a manner as to provide programming signals at the regulator output indirectly, through control circuitry, or directly, through a shunt connection between the regulator input and output.

DETAILED DESCRIPTION OF THE INVENTION

In the following description, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Figure 1:
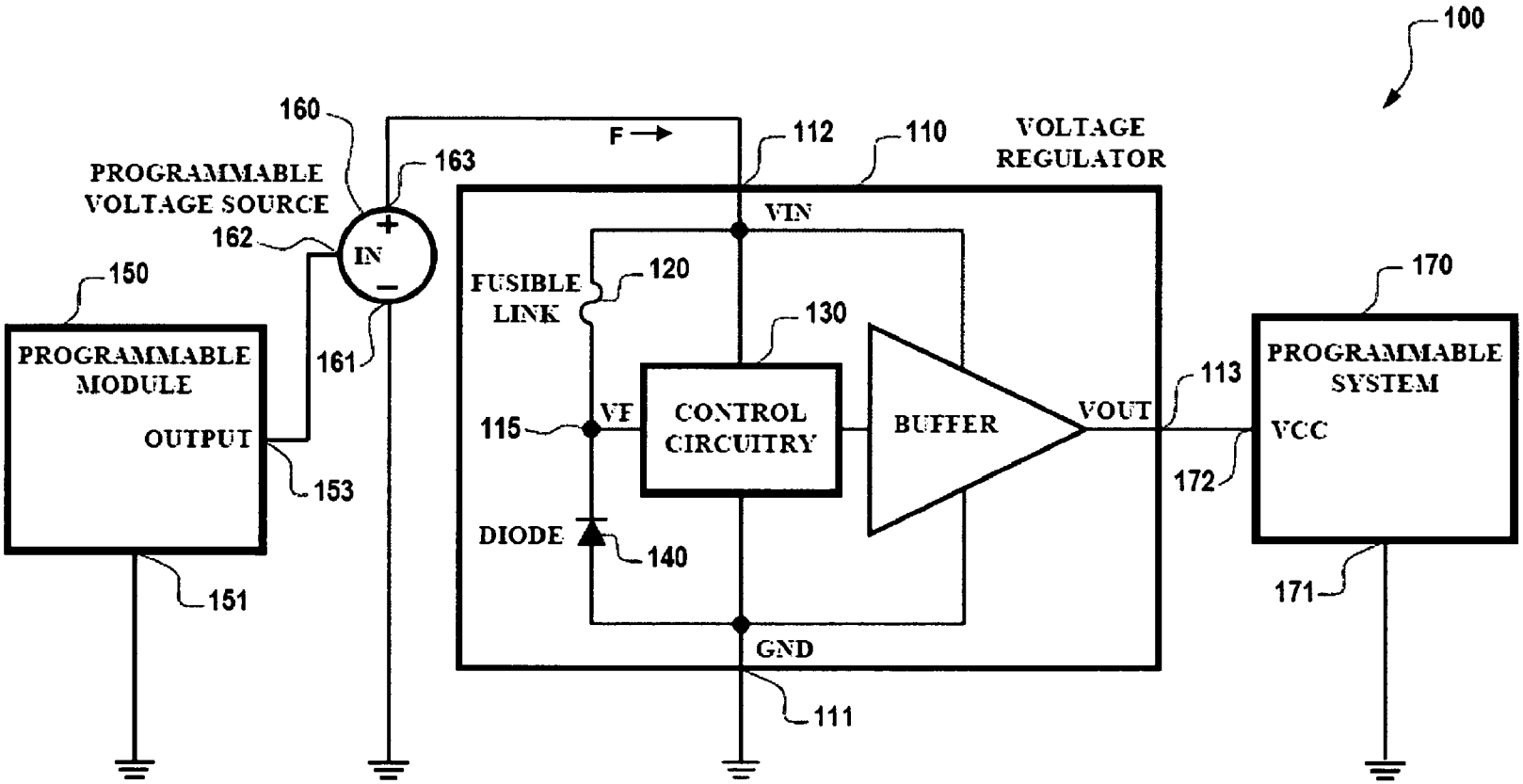
FIG. 1 illustrates a block diagram of a programmable system application.

A system utilizing the invention is generally indicated at 100 in FIG. 1, wherein all references to signal and voltage polarities are with respect to the voltage regulator GND terminal 111. The system depicted in FIG. 1 includes a voltage regulator 110 including a fusible link 120, control circuitry 130 and a diode 140. The system is operable in a programming mode while the fusible link 120 is closed and is operable in a regulated voltage mode when a fusible link 120 becomes open.

During programming mode, programming instructions can be generated within a programming module 150 in coordination with a programmable voltage source 160. The output terminal 153 of the programming module is connected to the input terminal 162 of the programmable voltage source 160. Programming instructions from the programming module 150 are converted to positive voltage signals of appropriate amplitude by the programmable voltage source, and the voltage signals are then passed from the (+) terminal 163 of the programmable voltage source 160 to the input VIN 112 of the voltage regulator 110.

The fusible link 120 connects the input VIN 112 of the voltage regulator 110 and the VF node 115 of the control circuitry 130. While the fusible link is closed (e.g., not "blown"), the control circuitry 130 responds to positive polarity voltage signals representing programming instructions at the VIN input 112 thereby producing an analog of said voltage signals at the VOUT terminal 113 of the voltage regulator 110. As shown in FIG. 1, the VOUT terminal 113 of the voltage regulator 110 is connected to the VCC input terminal 172 of the programmable system 170.

In a preferred embodiment, the programmable system 170 is a Hall effect sensor that can be calibrated with digital programming signals on its power input terminal but it can be appreciated that other types of sensors and systems may be represented by the programmable system 170. A signal path is provided through voltage regulator 110 for positive polarity voltage fluctuations, while the fusible link 120 is closed, and until system programming requiring variable voltage levels is complete. After programming of the regulated system 170 is completed, the programmable voltage source 160 provides a negative polarity voltage at the regulator VIN terminal 112, thereby causing the diode 140 to become forward biased, and thereby producing a large current flow through the diodo 140 and The fusible link 120 which subsequently causes the fusible link 120 to become opened (e.g., the fuse is "blown"). Opening of the fusible link 120 causes the voltage regulator 110 to begin operating at a regulated voltage when the voltage regulator VIN terminal 112 is there after supplied with a positive voltage from the programmable voltage source 160. Logically, the regulated voltage is made available to the VCC terminal 172 of the regulated system 170. Furthermore, it should be appreciated that programming is no longer possible without a closed fusable link 120.

The voltage regulator 110 can comprise a monolithic integrated circuit wherein the P-type substrate and N-type epitaxial layer are utilized to provide the junction diode 140. A common connection between the voltage regulator GND terminal 111 and respective terminals 151, 161 and 171, for the programming module, programmable voltage source and programmable system, provide paths for return currents in all operating modes.

Figure 2:
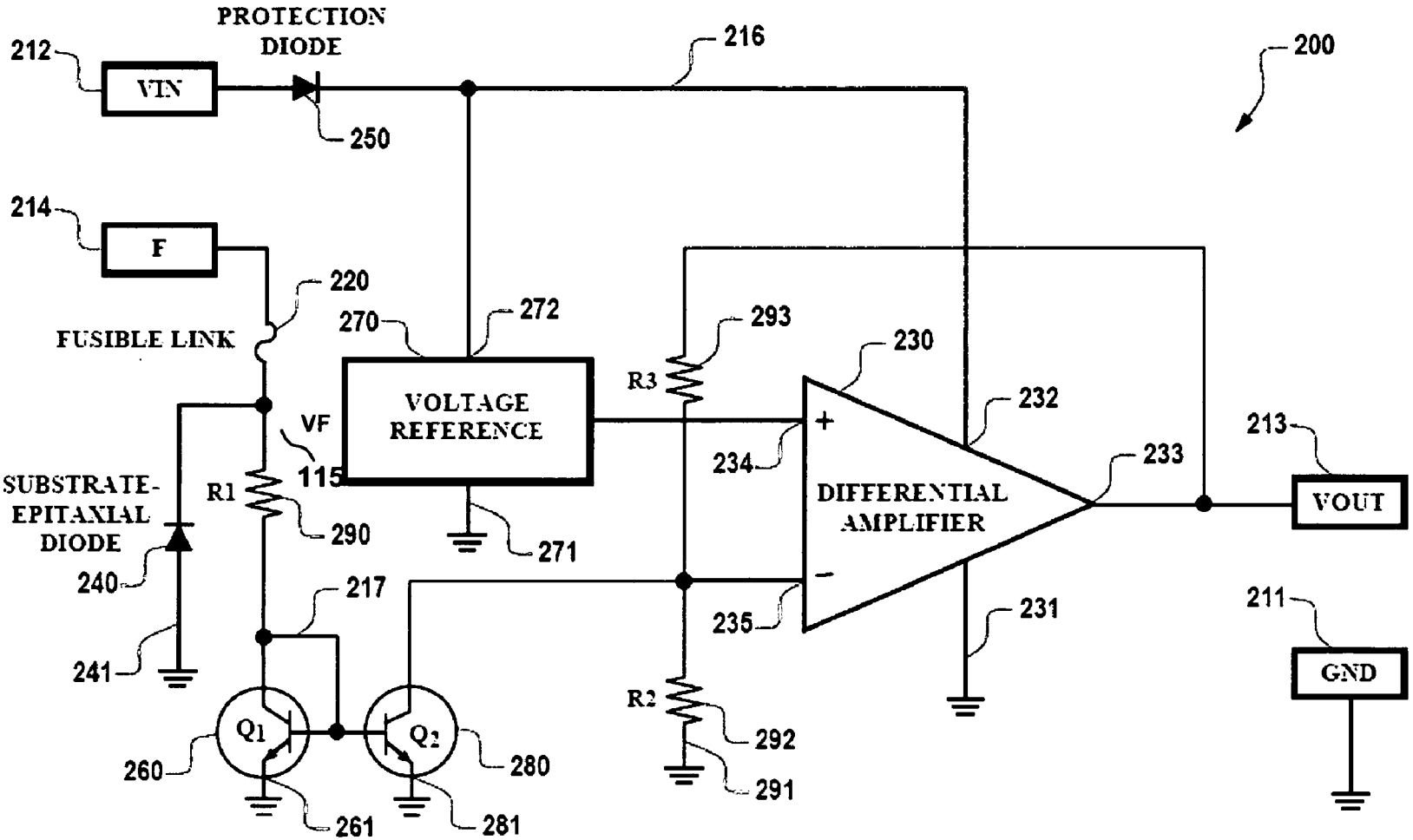
FIG. 2 illustrates a simplified schematic diagram of the voltage regulator with a control circuitry embodiment.

Referring to FIG. 2, an alternate embodiment is shown wherein a voltage regulator 200 is provided in the form of a monolithic semiconductor chip. Voltage regulator 200 includes a differential amplifier 230, configured in a non-inverting mode with the output of voltage reference 270 connected to the non-inverting input 234. Resistors R2 and R3, respectively numbered 292 and 293, indicate series-shunt feedback to provide a voltage transfer function between the voltage reference 270 and the VOUT terminal 213. Modification of the voltage transfer function distinguishes the programming mode during which a positive voltage on terminal F 214 causes a current to bias a current mirror comprising the respective transistors at 260 and 280, labeled Q1 and Q2. The resistor R1 290 establishes a current for a given value of positive voltage on terminal F 214. The current mirror of Q1 260 and Q2 280 sinks a proportional amount of current from the feedback network of R2 292 and R3 293 thereby modifying the voltage transfer function. All references to voltage polarities concerning FIG. 2 are with respect to a connection between the voltage regulator GND terminal 211 and common connection points of the differential amplifier at 231, the substrate-epitaxial diode at 241, the voltage reference at 271, the resistor labeled R2 at 291 and respective emitters of transistors labeled Q1 and Q2 at 261 and 281. The connection provides paths for return currents in all operating modes. In chip form, the voltage regulator 200 can typically include four external connection terminals.

During operation, an external voltage source is connected between the VIN terminal 212 and the GND terminal 211. A load in the form of a programmable system 170 that is similar in purpose to programmable module 150 shown in FIG. 2 can be powered by the voltage regulator 200. In this embodiment, the programmable system 170 is connected between the VOUT terminal 213 and the GND terminal 211. An additional connection is provided from the programmable system 170 to the fusible link 220 via the F terminal 214, to provide optional use of the programmability function. The fusible link 220 can be formed as patterned thin films including aluminum and nickel-iron, or aluminum and polycrystalline silicon as the materials.

During operation of the alternate embodiment, the F terminal 214 is connected to the VIN terminal 212 thereby allowing the programmability features from the programmable system 170 to be utilized once (or until no longer needed as explained in the operation of the programmable module 150 in FIG. 1), where after the fusible link 220 is opened by applying a negative voltage at the VIN terminal 212 and F terminal 214 thereby causing a large current to flow through the substrate-epitaxial diode 240 and fusible link 220 causing the fubile link 220 to become opened (e.g., "blown"), and thereby enabling voltage regulation mode by voltage regulator 200.

A protection diode 250 is connected between the VIN terminal 212 and the respective bias inputs of the voltage reference and differential amplifier at 272 and 232 to prevent large currents from flowing in these paths when a negative voltage is present at the VIN terminal 212. As another feature of the invention, independent control of the F terminal 214 allows switching between the voltage regulation and programming modes an unlimited number of times, whereby if terminal F at 214 is either connected to the GND terminal 211 or is left open (floated), the voltage regulator 200 operates in the regulated output mode only.

Figure 3:
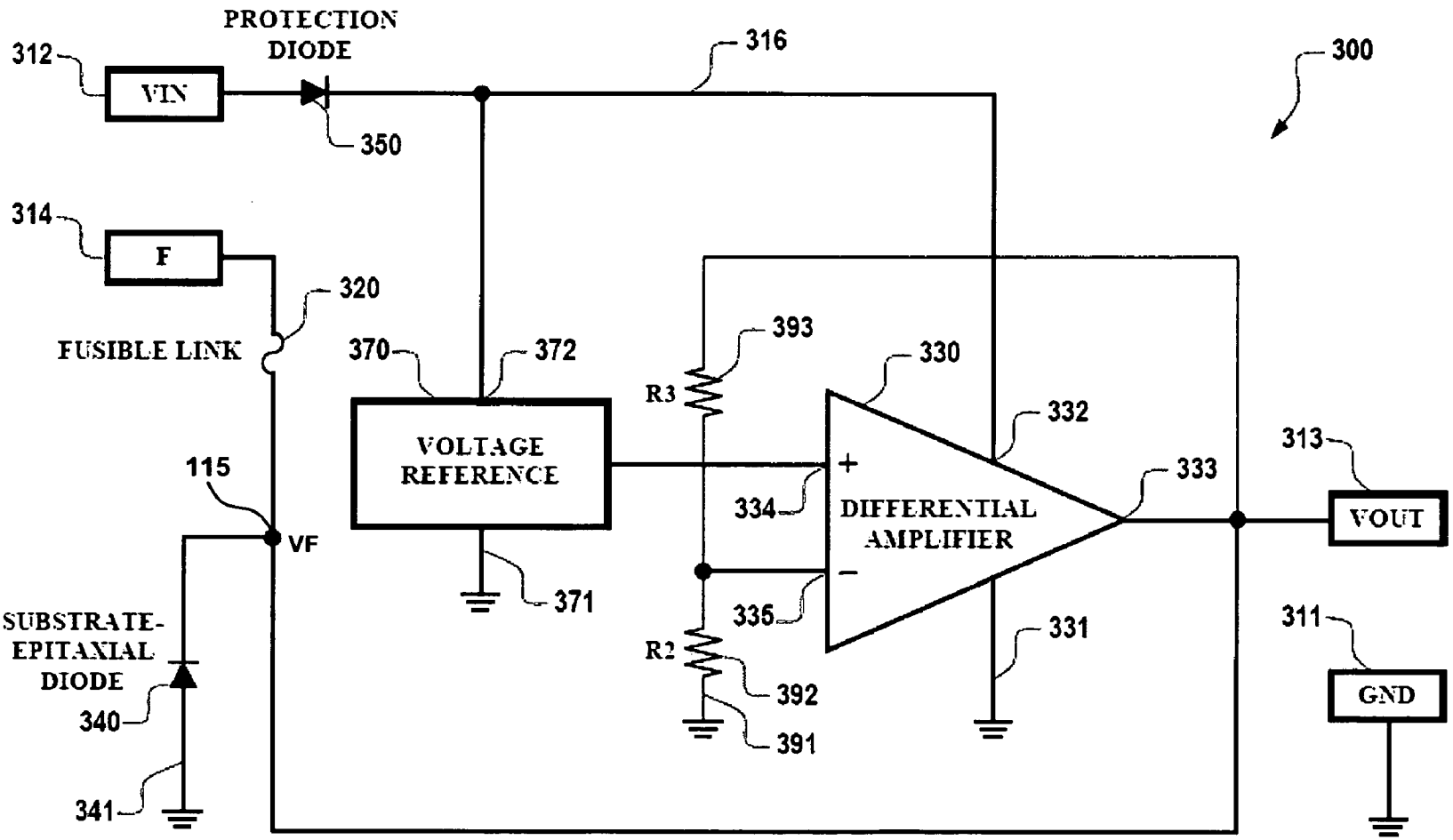
FIG. 3 illustrates a simplified schematic diagram of the voltage regulator with a shunt embodiment.

Referring to FIG. 3, voltage regulator 300 for another alternate embodiment of the invention can be provided in the form of a monolithic semiconductor chip. Voltage regulator 300 includes a differential amplifier 330, configured in a non-inverting mode with the output of voltage reference 370 connected to the non-inverting input 334. Resistors R2 and R3, respectively numbered 392 and 393, indicate series-shunt feedback to provide a voltage transfer function between the voltage reference 370 and the VOUT terminal 313. A fusible link 320 connects the F terminal 314 end the output terminal 313, thereby implementing the programmability function by providing a shunt current path to the regulator output terminal 313.

The fusible link 320 can be formed as patterned thin films including aluminum and nickel-iron, or aluminum and polycrystalline silicon as the materials. All references to voltage polarities concerning FIG. 3 are with respect to a connection between the voltage regulator GND terminal 311 and common connection points of the differential amplifier at 331, the substrate-epitaxial diode at 341 and the voltage reference at 371, and the resistor labeled R2 at 391. The connection provides paths for return currents in all operating modes. In chip form, the voltage regulator 200 can include four external connection terminals.

During operation of the system shown in FIG. 3, an external voltage source is connected between the VIN terminal 312 and the GND terminal 311. A load in the form of a programmable system that is powered by the voltage regulator 300 As connected between the VOUT terminal 313 and the GND terminal 311. A connection is provided to the fusible link 320, via the F terminal 314, to provide optional use of the programmability function. In this embodiment, the F terminal 314 is connected to the VIN terminal 312 thereby allowing the programmability option to be utilized once, where after the fusible link 320 is opened by applying a negative voltage at the VIN terminal 312 and F terminal 314, and thereby causes a large current to flow through the substrate-epitaxial diode 340 and fusible link 320, enabling the voltage regulation mode.

A protection diode 350 connected between the VIN terminal 312 and the respective bias inputs of the voltage reference and differential amplifier at 372 and 332 prevents large currents from flowing in these paths when a negative voltage is present at the VIN terminal 312. In this alternate embodiment, independent control of the F terminal 314 allows switching between the voltage regulation and programming modes an unlimited number of times, whereby if terminal F 214 is left open (floated), the voltage regulator 300 operates in the regulated output mode only.

The invention claimed is:

1. A programmable power supply, comprising:

a voltage regulator including a control circuit having an input VIN, the input VIN adapted to provide programming instructions in the form of variable frequency signals through a fusible link to the voltage regulator from a programmable module; and a fusible link connected between the input VIN and a VF node connected to the control circuit, and a diode connected to the VF node and a ground terminal connected to the voltage regulator;

wherein the control circuit is operable in a variable voltage mode while the control circuit receives programming instructions from a programmable module through the fusible link at the VF node while the fusible link is closed and the control circuit is further operable in a regulated voltage mode when the fusible link becomes opened when current is allowed to flow through the diode from its connection to the ground terminal after the programming instructions cease.

2. The voltage regulator of claim 1, comprising a monolithic semiconductor implemented as a semiconductor die.

3. The voltage regulator of claim 1, wherein the fusible link comprises patterned thin films including at least one of aluminum and nickel-iron, and at least one of aluminum and polycrystalline silicon.

4. The voltage regulator of claim 3, wherein said diode is integrated within a chip, the chip including a P-type substrate and an N-type epitaxial layer, wherein the P-type substrate acts as an anode and the N-type epitaxial layer acts as a cathode, and wherein a large current through the forward biased diode blows the fusible link, thereby enabling voltage regulation by the voltage regulator.

5. A voltage regulator, comprising a control circuit and a fusible link connecting a programming module to the control circuit, the fusible link adapted to provide a path for voltage regulator programming instructions to flow from the programming module to the control circuit, wherein the fusible link is connected to the control circuit through a VF node and the fusible link is further connected in parallel with a diode connected at the signal path and to a ground GND connection at the voltage regulator, and wherein voltage regulator programming instruction are enabled to flow to the control circuit while the fusible link is closed and the control circuit is further operable in a voltage regulation mode when a fusible link becomes open when current is allowed to flow through the diode after programming instruction cease.

6. The voltage regulator of claim 5, wherein the control circuit transfers signals of a positive polarity to the voltage regulator output while the fusible link remains closed and programming instruction are being received, and where after the fusible link becomes opened and causes the voltage regulator to begin operating at a regulated voltage when a negative polarity signal is applied to the regulator input thereby causing a negative polarity signal to pass through the fusible link.

7. The voltage regulator of claim 5, wherein the voltage regulator is a monolithic semiconductor implemented as a semiconductor die.

8. The voltage regulator of claim 5, wherein the fusible link is comprised of patterned thin films that include at least one of aluminum and nickel-iron, and at least one of aluminum and polycrystalline silicon.

9. The voltage regulator of claim 5, wherein said diode is integrated within the chip, the chip including a P-type substrate and N-type epitaxial layer, wherein the P-type substrate acts as an anode and the N-type epitaxial layer acts as a cathode, and wherein a large current flows through the forward biased diode and blows the fusible link, thereby enabling voltage regulation by the control circuit.

10. A voltage regulator, comprising:

a control circuit formed on a semiconductor chip; and a fusible link connecting the voltage regulator input and at least one of the control circuit or the output, said fusible link further comprised of patterned thin films including at least one of aluminum and nickel-iron, and at least one of aluminum and polycrystalline silicon, wherein said control circuit inoperable in a voltage regulation mode while the fusible link is closed and operable in a regulated voltage mode when the fusible link becomes open;

wherein the control circuit responds to variable voltage levels of positive polarity at the regulator input, with an analog of said variable voltage levels at the regulator output, until system programming requiring variable voltage levels is complete, where after a negative polarity voltage applied to the regulator input causes a large current to pass through the fusible link once the system programming is completed, said current thereby causing the fusible link to become opened and enabling the voltage regulator to begin operating at a regulated voltage when a positive input voltage is applied.

11. The voltage regulator of claim 10, wherein the voltage regulator further comprises input and output terminals and the fusible link is connected between one input and the control circuit, and the control circuit is connected through a buffer to the output terminal.

12. The voltage regulator of claim 11, said voltage regulator including at least one common terminal, and further comprising a diode connected between the output and at least one common terminal to provide conduction through the fusible link when input voltage to the voltage regulator is reversed.

13. The voltage regulator of claim 12, wherein said diode is integrated within the chip, the chip including a P-type substrate and N-type epitaxial layer, wherein the P-type substrate acts as an anode and the N-type epitaxial layer acts as a cathode, and wherein a large current flows through the forward biased diode and blows the fusible link, thereby enabling voltage regulation by the voltage control circuit.

* * * * *